United States Patent [19]

Jajko et al.

[11] Patent Number: 4,807,327

[45] Date of Patent: Feb. 28, 1989

[54] DIRT DEFLECTOR FOR CLEANING HEADS

[75] Inventors: Robert A. Jajko, Villa Park; Oliver M. Julien, Barrington, both of Ill.

[73] Assignee: Elgin Sweeper Company, Elgin, Ill.

[21] Appl. No.: 172,549

[22] Filed: Mar. 24, 1988

[51] Int. Cl.[4] ..... E01H 1/08

[52] U.S. Cl. ..... 15/346

[58] Field of Search ..... 15/346, 340

[56] References Cited

U.S. PATENT DOCUMENTS

| | | | |
|---|---|---|---|
| 3,512,206 | 5/1970 | Young | 15/346 |
| 4,109,341 | 8/1978 | Larsen et al. | 15/346 X |
| 4,110,864 | 9/1978 | Gunnarsson | 15/346 X |
| 4,466,156 | 8/1984 | Blehert | 15/346 |
| 4,660,248 | 4/1987 | Young | 15/346 X |

*Primary Examiner*—Chris K. Moore

*Attorney, Agent, or Firm*—Charles F. Pigott, Jr.; Garrettson Ellis

[57] ABSTRACT

A cleaning head for an air flow type cleaner defines an open-faced chamber for facing the surface to be cleaned. An air recirculating conduit draws air from the chamber through a first port in the chamber adjacent one end thereof. A baffle in the cleaning head is positioned substantially between the one end and the first port to reduce the flow of dirt-laden air to the one end. By this invention, one or more apertures provide communication at a central portion of the baffle substantially between the first port and that volume within the chamber which extends between the baffle and the one end, to provide air suction to prevent dirt accumulation in that volume.

20 Claims, 1 Drawing Sheet

DIRT DEFLECTOR FOR CLEANING HEADS

BACKGROUND OF THE INVENTION

One particularly desirable form of street sweeper is the recirculating air sweeper, in which dirt which has been disturbed by a brush passes into a cleaning head, and is drawn into a recirculating air flow pattern which conveys the dirt to a dust collector, and permits the air with reduced dirt and dust to recirculate back to the cleaning head. By this means, the street sweeper does not have a large air exhaust which, without a filter, would spew air with a certain amount of dust and dirt back onto the street. The volume of dirt and dust are so great that it is not practical to attempt to use any kind of a filter for the air stream, which would clog too rapidly.

In a typical cleaning head, recirculating air flows into an open-faced chamber with the open face directed downwardly to receive dirt from the street. The vigorously recirculating air enters the chamber, typically through a slot which extends most of the width thereof, while the recirculating air is drawn out of the chamber through an outlet port adjacent one end thereof.

It has been found that as dirt picks up a significant velocity in the chamber moving toward the outlet port, some of the dirt can fly right by the outlet port, falling out of the head along its side, resulting in incomplete dirt pickup. In an attempt to prevent this, a baffle has been made in a prior art design, being positioned between the side wall of the cleaning head and the outlet port to stop dust from flying laterally past the outlet port. However, even in this circumstance, dirt has been found to collect behind the baffle and then fall back to the street, so that under certain dirt pickup conditions, the street sweeper can leave a trail of dirt behind, resulting from dirt collecting and then falling out of the area behind the baffle relative to the outlet port.

By this invention, a cleaning head is modified to significantly reduce this problem, so that laterally moving dirt does not readily fly past the outlet port, but rather is stopped and sucked through the port with recirculating air. At the same time, dirt does not collect in large quantities behind the baffle of this invention, but rather is also sucked into the outlet port with recirculating air.

DESCRIPTION OF THE INVENTION

In accordance with this invention, apparatus for cleaning surfaces with air flow, and preferably recirculating air flow, includes a cleaning head which defines an open-faced chamber for facing the surface to be cleaned, for example, the street. Air recirculating conduit means are provided for withdrawing air from the chamber through a first port in the chamber adjacent one end thereof, and for blowing the recirculated air through a second port back into the chamber. The air recirculating conduit means includes conventional impeller means for circulating air through the conduit means, and also conventional dirt collector means in the conduit means. Baffle means are positioned substantially between the one end and the first port to reduce the flow of dirt laden air to the one end, so that the dirt laden air is induced to remain in the vicinity of the first port for being withdrawn therethrough.

In accordance with this invention, aperture means are provided, providing communication at a typically central portion of the baffle means between substantially the first port and that volume within the chamber which extends between the baffle means and the one end. The effect of this is to provide access for flowing air to the area behind the baffle, between the first port and the one end, where in the prior art designs dirt would accumulate. This, in turn, provides a suction flow and swirling through that volume, inducing dirt which has found its way around the baffle to be drawn back into the first port with recirculating air. Thus, the cleaning head of this invention exhibits far less tendency to spill dirt out of its side adjacent the first port, or to leave a trail of dirt, as prior art baffled cleaning heads tend to do.

The open-faced chamber may carry resilient flaps extending about the open face in substantial engagement with the surface to be cleaned such as the street. This provides at least a partial seal of the chamber, and of the air recirculating conduit means.

The baffle means may define at least a pair of baffle sections, which are centrally spaced from each other so that a central gap is provided to define at least part of the aperture means.

Alternatively or additionally, the baffle means may intersect the first port, so that a typically small portion of the first port communicates with the outer or rear face of the baffle, which defines at least part of the aperture means.

Alternatively or additionally, the baffle means may simply define a cut-away aperture to define at least part of the aperture means.

DESCRIPTION OF DRAWINGS

Referring to the drawings.

DESCRIPTION OF SPECIFIC EMBODIMENTS

Figure 1:
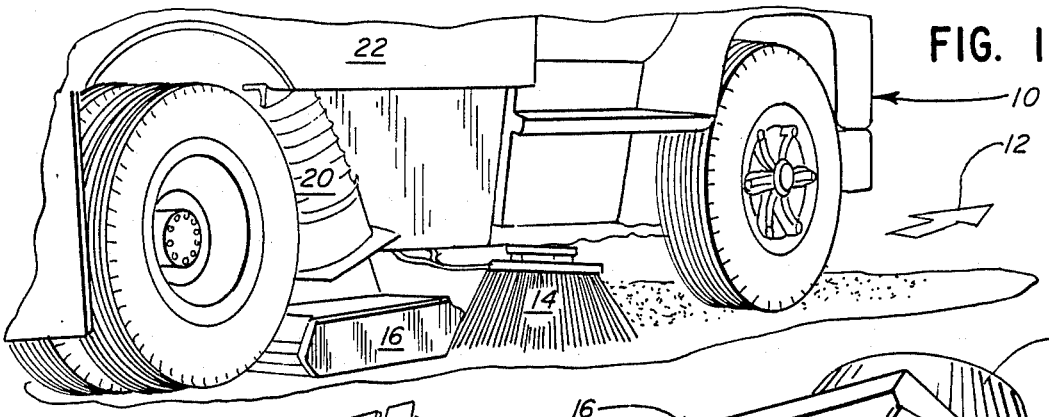
FIG. 1 is a fragmentary perspective view of a street sweeper which carries a recirculating air system and a cleaning head in accordance with this invention.
Figure 2:
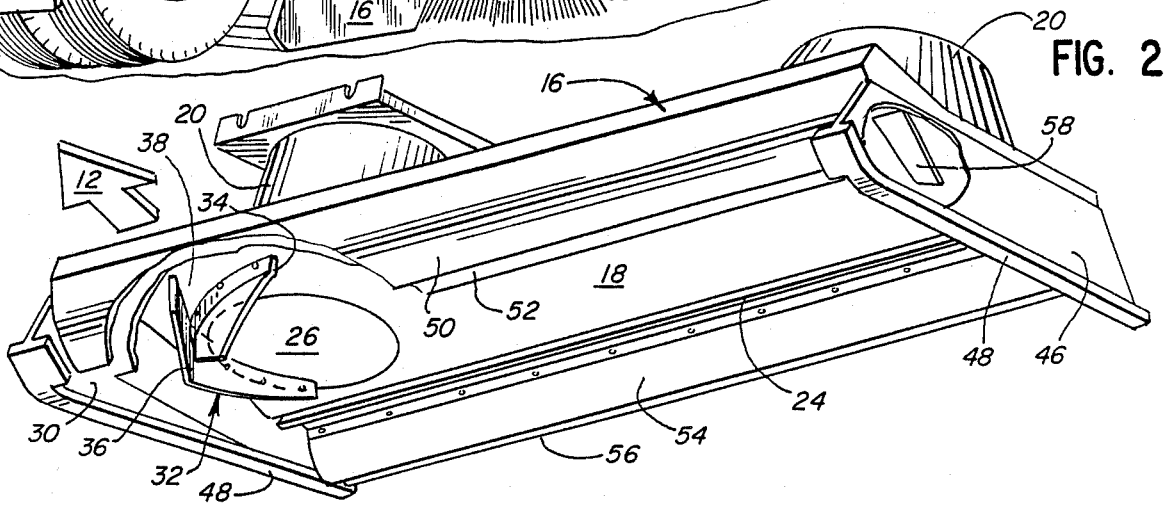
FIG. 2 is a perspective view, with portions broken away, of the cleaning head of FIG. 1 showing one embodiment of the invention.
Figure 3:
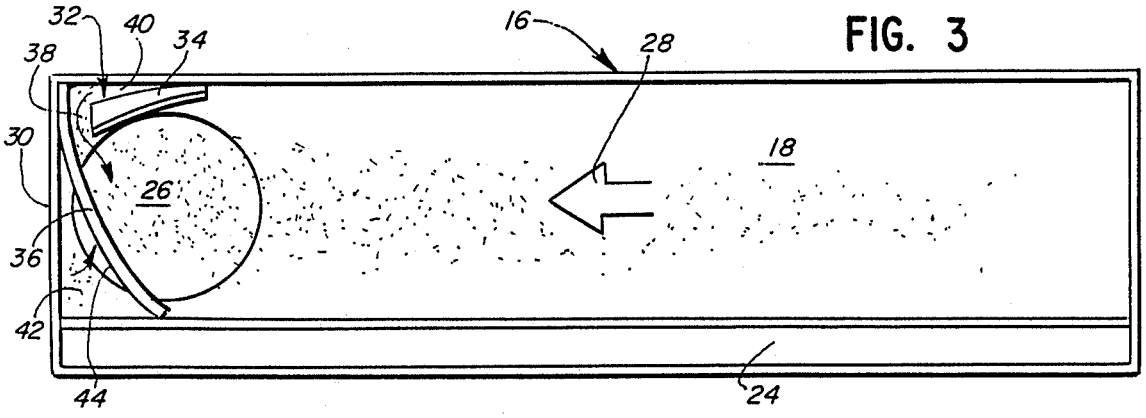
FIG. 3 is a bottom plan view of the cleaning head of FIG. 2.

Referring to FIGS. 1 through 3, a street sweeper vehicle 10 is disclosed which typically moves forward in direction 12 for cleaning of the street. Brushes 14 may be provided in conventional manner to disturb and loosen the dirt, and the loose dirt is then overridden by cleaning head 16. Cleaning head 16 defines an open-faced chamber 18 with the open face directed downwardly. Chamber 18 communicates with air recirculating conduit system 20 by means of which air is drawn out of chamber 18, passed through conventional impeller and dirt collector system 22, and then returned to chamber 18 through an inlet port 24, which is shown to be a highly elongated slot, extending substantially the length of cleaning head 16. Head 16 may be of a vacuum or of a positive pressure blower type.

Impeller and dirt collection system 22 may be of conventional, well-known design. Particularly, the impeller and dirt collector system may be of the design as disclosed in Hilger et al, U.S. patent application Ser. No. 965,550, filed Sept. 14, 1987 and entitled Dust Separator for Gas Stream. Alternatively, other commercially available systems may be used as well for both impeller and dust collector system 22, but also for the overall design of air recirculating system 20 and for cleaning head 16, except as otherwise described herein.

Recirculating air is drawn out of chamber 18 through first port 26, which communicates with air recirculating conduit 20. Accordingly, as shown somewhat schematically in FIG. 3, air flows out of inlet port 24 into chamber 18 substantially all along the entire length (or width from the viewpoint of direction 12) of the chamber.

Air is drawn out of chamber 18 through first port 26. Accordingly, the air in the chamber assumes a net leftward velocity as shown in FIG. 3 and indicated by arrow 28. Because of this velocity, in certain conventional, unbaffled designs of cleaning heads, some of the laterally moving air can flow by outlet port 26, throwing the dust against end wall 30, the effect being that some of the dust escapes once again and is not drawn through outlet port 26.

In accordance with this invention, a baffle member 32 of special shape is provided, which exhibits advantages as previously described. Baffle means 32 can be seen in FIGS. 2 and 3 to comprise a pair of individual walls 34, 36, which may be bolted or otherwise attached to cleaning head 16 as shown. Walls 34, 36 are separated at a central portion of the extent of the walls from one end of one of the walls to the remotest end of the other, to define an aperture 38, which communicates with a volume of space 40 in chamber 18 which is blocked by wall 34 from outlet port 26.

Accordingly, as dirt seeps back into volume 40, the suction pressure provided through aperture 38 from first port 26 tends to urge free dirt back toward port 26, for entering the recirculating airstream through recirculating flow path 20. Accordingly, dirt which gets into volume 40 is typically not lost to the cleaning head, but rather is once again caught in the suction of air through port 26 for collection, rather than eventually falling out of the cleaning head back onto the street.

Similarly, wall 36 is equipped with aperture means as well to provide a suction to the volume 42 of chamber 18 which is generally behind wall 36 with respect to most of first port 26. This is accomplished, as shown particularly in FIG. 3, by causing wall 36 to intersect port 26 so that a small portion 44 of port 26 is in communication with the rear surface of wall 36, facing away from most of port 26. Because of this, a constant suction is applied to the volume 42 which is mostly separated from port 26 by wall 36, so that free dirt tends to be sucked into aperture portion 44 of port 26 rather than falling back onto the road out of cleaning head 16.

Accordingly, by this invention, dirt which achieves enough velocity by flow within cleaning head 16 to pass outlet port 26 and to get to the area of end wall 30 can once again be recollected by the respective apertures 38, 44 in accordance with this invention, so that such dirt does not accumulate and fall back out of cleaning head 16 onto the road, resulting in an incomplete cleaning job.

Also, walls 34, 36 are preferably somewhat curved as shown so as to provide a swirling action to air which passes into outlet port 26. This provides better debris pick-up through higher air velocity and less air turbulence.

Cleaning head 16 is equipped with sidewall 30 on one end as previously stated, and another side wall 46 on the opposed end. These sidewalls may be reinforced with bottom runners 48 for intermittent scraping with the road. Also, the front end of cleaning head 16 may carry a pair of resilient flaps 50, 52 which typically ride just above the surface being cleaned in substantial engagement therewith, but typically providing a narrow horizontal aperture so that the dirt on the surface is not pushed out of the way as cleaning head 16 advances. Another pair of such flap means 54, 56 may be provided at the rear of cleaning head 16, the respective flaps being all in near engagement with the surface to be cleaned to provide at least a partial seal of the chamber 18 and air recirculating conduit system 20. Flap restraint member 58 may be provided to support the front inner flap 52, to prevent undue inward bending, with another restraint member being positioned on the other side of cleaning head 16.

Figure 4:
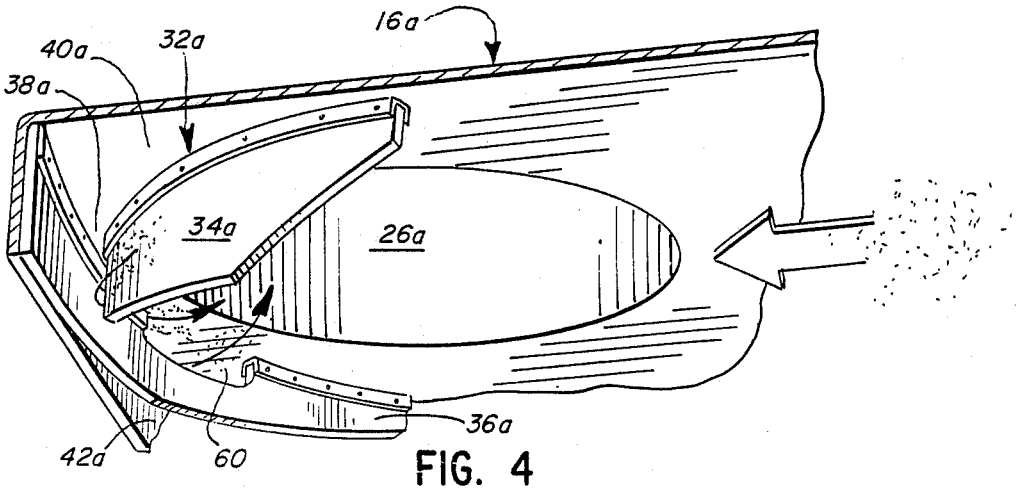
FIG. 4 is an enlarged, fragmentary perspective view of a modified cleaning head in accordance with this invention.

Referring now to FIG. 4, another embodiment of cleaning head **16*a* is provided, being of similar structure to cleaning head 16, except as otherwise described herein. As shown, cleaning head 16*a* defines an outlet port 26*a* which communicates with a recirculating air flow system in the manner of the previous embodiment. Baffle means 32*a* is once again provided including a pair of walls 34*a*, 36*a*. The two walls 34*a*, 36*a* are separated by an aperture 38*a* as in the previous embodiment for the same function of providing circulating air flow to the volume 40*a* of space which is isolated from outlet port 26*a* by wall 34*a***.

By the modification of this invention, one may position wall **36*a* in spaced relation with outlet port 26*a*. However, one may provide an aperture 60 in wall 36*a* which serves the similar function of providing an air circulation flow to the volume of space 42*a* which is separated from outlet port 26*a* by wall 36*a*, so that loose dirt cannot collect in that volume either, but is sucked into outlet port 26*a***. to achieve the advantages of this invention as previously described.

The above has been offered for illustrative purposes only, and is not intended to limit the scope of this application, which is as defined in the claims below.

That which is claimed is:

1. In apparatus for cleaning surfaces with recirculating air flow including a cleaning head defining an open-faced chamber for facing the surface to be cleaned; air recirculating conduit means for drawing air from said chamber through a first port in said chamber adjacent one end thereof, and for blowing air through a second port into said chamber, said air recirculating conduit means including impeller means for circulating air through said conduit means and dirt collector means in said conduit means; and baffle means positioned in said cleaning head substantially between said one end and said first port to reduce the flow of dirt-laden air to said one end, the improvement comprising, in combination:

aperture means providing communication at a central portion of said baffle means substantially between said first port and that volume within said chamber which extends between said baffle means and said one end.

2. The apparatus of claim 1 in which said open-faced chamber carries resilient flap means extending about said open face into effective engagement with the surface to be cleaned, to provide at least a partial seal of said chamber and air recirculating conduit means.

3. The apparatus of claim 1 which is mounted on a vehicle.

4. The apparatus of claim 1 in which said baffle means defines at least a pair of generally curved baffle sections, centrally spaced from each other to define at least part of said aperture means.

5. The apparatus of claim 1 in which said baffle means intersects said first port to define at least part of said aperture means.

6. The apparatus of claim 1 in which said baffle means defines a cut-away aperture to define at least part of said aperture means.

7. In a street sweeping apparatus with recirculating air flow including a cleaning head defining an open-faced chamber for facing the street; air recirculating conduit means for drawing air from the chamber from a first port in the chamber adjacent one end thereof and for blowing air through a second port into said chamber, said air recirculating conduit means including impeller means and dirt collector means; and baffle means positioned in said cleaning head substantially between said one end and the first port to reduce the flow of dirt-laden air to said one end, said open-faced chamber carrying resilient flap means extending about said open face into effective engagement with the surface to be cleaned, to provide at least a partial seal of said chamber and air recirculating conduit means, the improvement comprising, in combination:

aperture means providing communication at a central portion of said baffle means substantially between said first port and that volume within said chamber which extends between said baffle means and said one end.

8. The apparatus of claim 7 in which said baffle means defines at least a pair of baffle sections, centrally spaced from each other, to define at least part of said aperture means.

9. The apparatus of claim 8 in which at least one of said baffle sections intersects the first port to define at least part of said aperture means.

10. The apparatus of claim 8 in which at least one of said baffle sections defines a cut-away aperture to define at least part of said aperture means.

11. The apparatus of claim 7, in which said baffle means defines at least one generally curved baffle section to impart swirling action to air passing through said first port.

12. A cleaning head for air flow type cleaning apparatus, which cleaning head defines an open-faced chamber for facing the surface to be cleaned, a first port in said chamber adjacent one end thereof and a second port positioned in said chamber for respectively withdrawing and inserting recirculating air through said chamber, and baffle means positioned in said cleaning head substantially between said one end and said first port to reduce the flow of dirt-laden air to said one end, the improvement comprising, in combination:

aperture means providing communication at a central portion of said baffle means substantially between said first port and that volume within said chamber which extends between said baffle means and said one end.

13. The apparatus of claim 12 in which said open-faced chamber carries resilient flap means extending about said open face into effective engagement with the surface to be cleaned, to provide at least a partial seal of said chamber.

14. The apparatus of claim 12 in which said baffle means defines at least a pair of baffle sections, centrally spaced from each other to define at least part of said aperture means.

15. The apparatus of claim 12 in which said baffle means intersects said first port to define at least part of said aperture means.

16. The apparatus of claim 12 in which said baffle means defines a cut-away aperture to define at least part of said aperture means.

17. The apparatus of claim 12 in which said baffle means defines a pair of baffle sections, centrally spaced from each other to define at least part of said aperture means, a second portion of said aperture means being also defined by said baffle means.

18. The apparatus of claim 17 in which said second portion of the aperture means is defined by one baffle section intersecting said first port.

19. The apparatus of claim 17 in which said second portion of the aperture means is defined by a cut-away aperture defined on one of the baffle sections.

20. The apparatus of claim 12, in which said baffle means defines at least one generally curved baffle section to impart swirling action to air passing through said first port.

* * * * *